United States Patent [19]

DeGuvera

[11] Patent Number: 4,526,077

[45] Date of Patent: Jul. 2, 1985

[54] HEAVY DUTY PUNCH

[75] Inventor: Emmett W. DeGuvera, Grosse Pointe Woods, Mich.

[73] Assignee: Detroit Punch & Retainer Corporation, Fraser, Mich.

[21] Appl. No.: 515,807

[22] Filed: Jul. 21, 1983

[51] Int. Cl.[3] ..... B26F 1/14; B21D 28/26

[52] U.S. Cl. ..... 83/686; 83/698

[58] Field of Search ..... 83/685-691, 83/30, 50, 55, 660, 522; 72/327, 479

[56] References Cited

U.S. PATENT DOCUMENTS

| | | | |
|---|---|---|---|
| 904,714 | 11/1908 | McGrath | 83/686 |
| 1,569,136 | 1/1926 | Pardec | 83/687 |
| 3,807,212 | 4/1974 | Lawson | 76/107 R |
| 4,273,015 | 6/1981 | Johnson | 83/690 |

FOREIGN PATENT DOCUMENTS

| | | | |
|---|---|---|---|
| 77799 | 6/1977 | Japan | 83/686 |

*Primary Examiner*—James M. Meister
*Assistant Examiner*—John L. Knoble
*Attorney, Agent, or Firm*—Barnes, Kisselle, Raisch, Choate, Whittemore & Hulbert

[57] ABSTRACT

A heavy duty punch for piercing armor plate and the like having a piercing end which is generally cylindrical and terminates in a conical tip. The punch has a shank which is received in the socket of a punch holder. The punch holder has gripping jaws cooperable to releasably grip the punch shank.

2 Claims, 10 Drawing Figures

FIG. 7
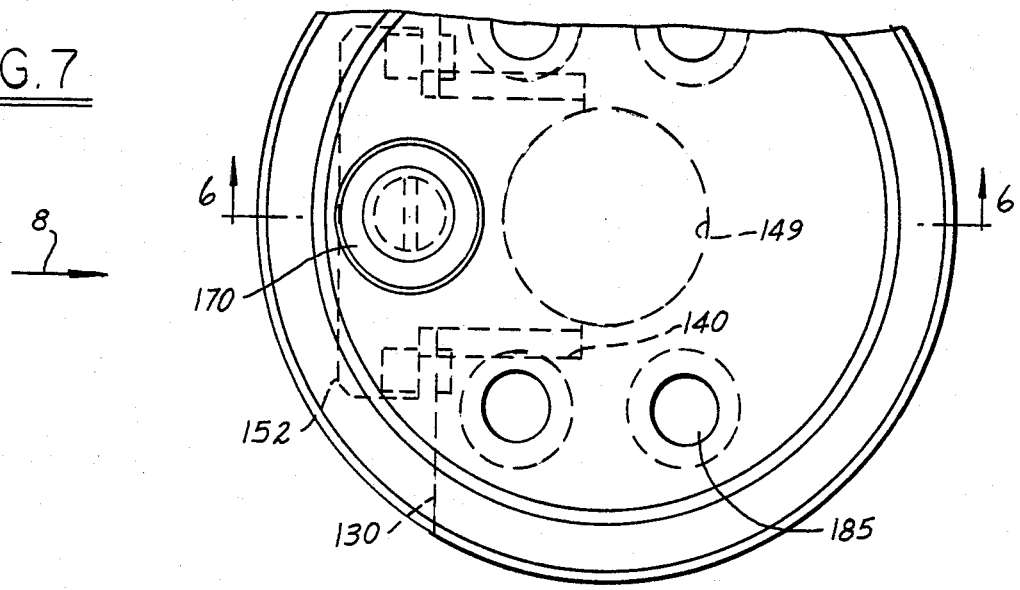
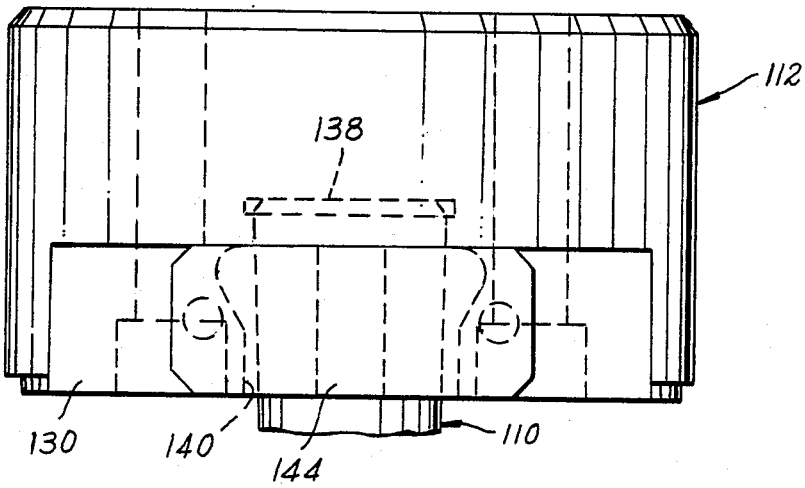
FIG. 8
FIG. 9
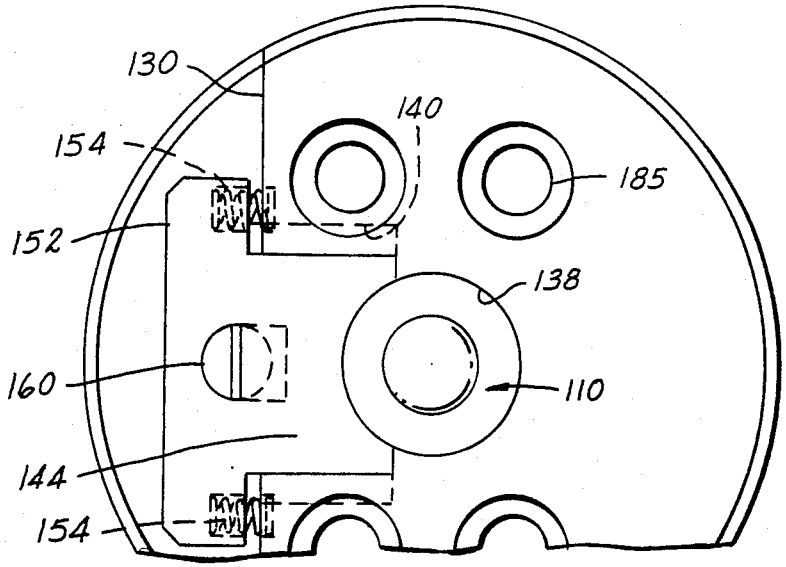

HEAVY DUTY PUNCH

This invention relates generally to a heavy duty punch for piercing armor plate and the like, and to a holder for the punch.

BACKGROUND AND SUMMARY OF THE INVENTION

At the present time, holes are formed in high strength armor plate of the type used in tanks and other military vehicles primarily by drilling, which is time-consuming and expensive. Drills must be re-sharpened or replaced after the formation of only a relatively few holes. It is a principal object of this invention to provide a heavy duty punch capable of forming large numbers of holes in less time and hence at less cost, to provide a punch which is durable and long-lasting and to provide an improved holder for the punch.

The heavy duty punch of this invention is adapted for piercing armor plate and the like. The punch has a shank by means of which it may be held during use. The punch also has a piercing end projecting axially from the shank. The piercing end is generally cylindrical and terminates in a conical tip.

In the embodiments about to be described, the dimensions of the punch are specified for optimum performance, particularly with reference to the cone angle on the piercing end of the punch, the curve connecting the generally cylindrical surface of the piercing end with the outer margin of the conical tip, and the flare of the generally cylindrical surface of the piercing end.

Also in accordance with the specified embodiments about to be described, the holder for holding the heavy duty punch during a piercing operation comprises a body having a socket adapted to receive the shank of the punch. Gripping jaws are provided to releasably grip the shank. In one embodiment about to be described, two guide slots in the body communicate with opposite sides of the socket. The two jaws slidably mounted in the respective slots are adapted to be advanced and retracted into and out of gripping engagement with the shank. In another embodiment, one jaw is fixed and the other is slidably mounted. When the slidable jaw is advanced, the slidable and fixed jaws cooperate in gripping the shank of the punch. Means are provided for selectively advancing and retracting the gripping jaw or jaws.

Preferably, the shank of the punch is generally cylindrical but tapers outwardly relatively to the socket, and the shank-engaging surfaces of the gripping jaws taper at the same angle as the shank in order to have full surface contact therewith.

These and other objects of the invention will become apparent as the following description proceeds, especially when considered with the accompanying drawings.

BRIEF DESCRIPTION OF THE DRAWINGS

FIG. 7 is a view looking in the direction 7 in FIG. 6.

FIG. 8 is an elevational view looking in the direction 8 in FIG. 7.

FIG. 9 is a view looking in the direction of the arrow 9 in FIG. 6.

DETAILED DESCRIPTION

Figure 1:
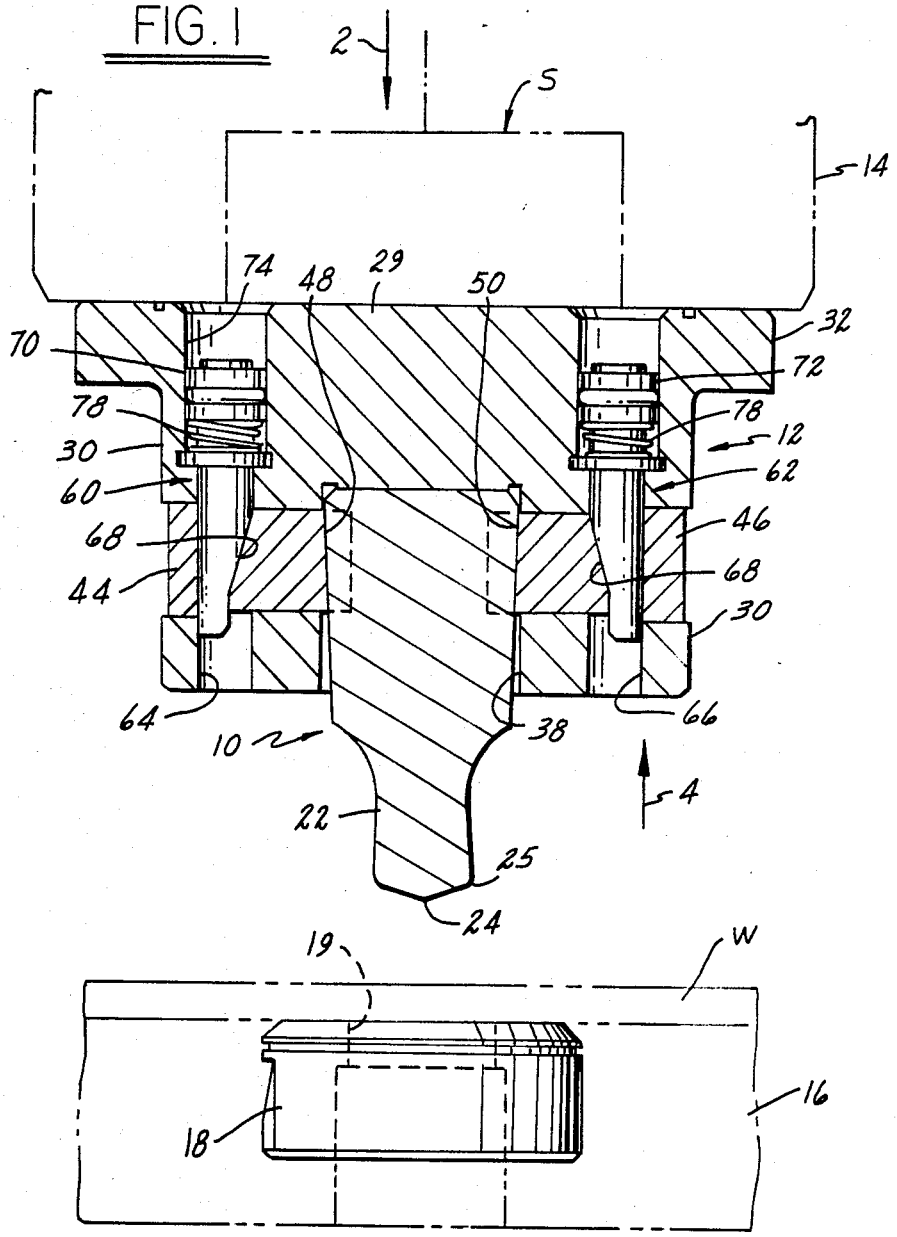
FIG. 1 is a sectional view of the heavy duty punch and holder of this invention, taken on the line 1—1 in FIG. 2.

Referring now more particularly to the drawings and especially to FIGS. 1–5, the heavy duty punch 10 is mounted in a holder 12 carried by a ram 14 which is reciprocable vertically above a table 16 on which a work piece W, in this instance heat-treated, high strength armor plate, is supported. When the ram moves downwardly, the punch 10 in cooperation with the die or button 18 in the table forms a hole in the work piece and pushes a slug of punched out metal through the central opening 19 in the button.

Figure 5:
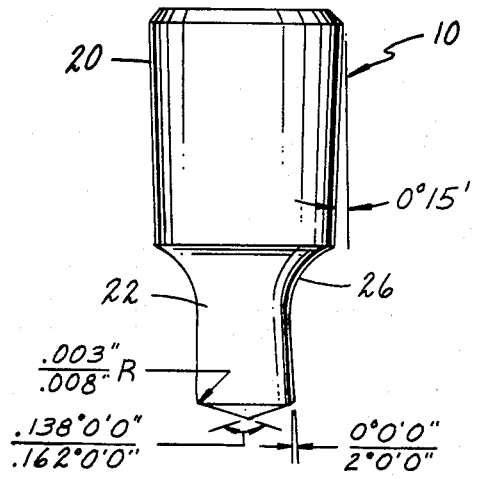
FIG. 5 is a detail view in elevation of the punch.

The punch 10 is made of a suitable heavy duty material such as tool steel and has a generally cylindrical shank 20 and a piercing end 22 projecting axially from the shank. The specific dimensions of the punch may vary, depending upon the hardness of the armor plate. The punch 10 is designed to punch holes in armor plate of somewhat less hardness than the armor plate. The shank of punch 10, while generally cylindrical actually tapers in an outward direction, that is in a direction towards the piercing end. Preferably the angle of taper is 0° 15′ as indicated in FIG. 5 of the drawing.

The piercing end of the punch is generally cylindrical, and its central axis coincides with the central axis of the shank. The piercing end may be truly cylindrical or it may flare in a direction toward the tip from 0° to 2°.

The piercing end terminates in a conical tip 24 in which the cone angle is 138° to 162°. The generally cylindrical surface of the piercing end connects with the outer margin of the conical tip in a curve 25 having a radius of 0.003″ to 0.008″. The piercing end blends into the shank in a flaring curve of suitable radius where indicated at 26. The piercing end preferably has a boron coated tip to increase the hardness thereof, resulting in improved wear and anti-galling properties.

There will be a clearance between the piercing end 22 of the punch and the die opening 19. For example, the diameter of the piercing end at its tip may be 0.4″ and the diameter of the die opening may be 0.475″. Armor plate thickness may, for example, be in a range from 5/32″ to ¼″.

The punch holder 12 comprises a generally cylindrical body 29 having parallel flats 30 machined or otherwise formed in opposite sides beneath the base 32 thereof, which flats extend from the base to the outer end of the body. Grooves 34 are machined or otherwise formed across the full extent of the flats, extending into the cylindrical wall portions of the body beyond the ends of the flats. The bottoms 36 of the grooves are preferably flat and parallel to the flats 30, as shown.

The punch holder 12 has a cylindrical socket 38 in the outer end, the central axis of which coincides with the central axis of the cylindrical body 29. Slots 40 and 42 are machined or otherwise formed in the body 29 of the punch holder and extend from the bottoms 36 of the grooves 34 through the cylindrical wall of the socket 38. These slots are aligned with one another and open into the socket at opposite sides thereof.

Gripping jaws 44 and 46 are slidably mounted in the respective slots 40 and 42 for radially inward and outward movement relative to the socket. These jaws have concave gripping surfaces 48 and 50 adapted to grip and hold the shank of the punch 10 received therein. The gripping surfaces 48 and 50 are tapered and contoured so as to match the generally cylindrical but slightly tapered side wall of the shank so that in the inner or advanced positions of the gripping jaws the surfaces 48, 50 engage the wall of the shank in full surface contact therewith. The gripping surfaces 48, 50 may, for example, be formed of electroplated carbon steel for improved gripping.

Figure 2:
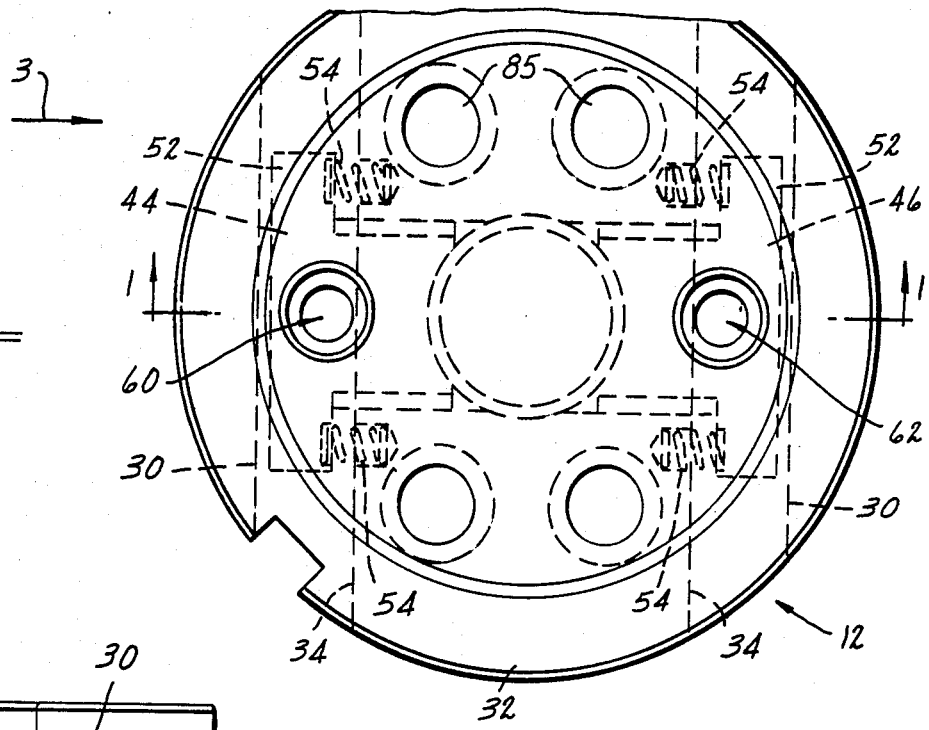
FIG. 2 is a view looking in the direction of the arrow 2 in FIG. 1.
Figure 3:
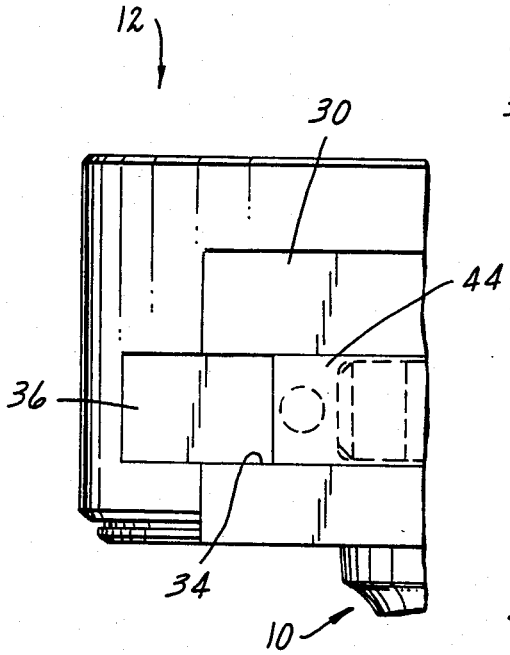
FIG. 3 is a fragmentary elevational view looking in the direction of the arrow 3 in FIG. 2.
Figure 4:
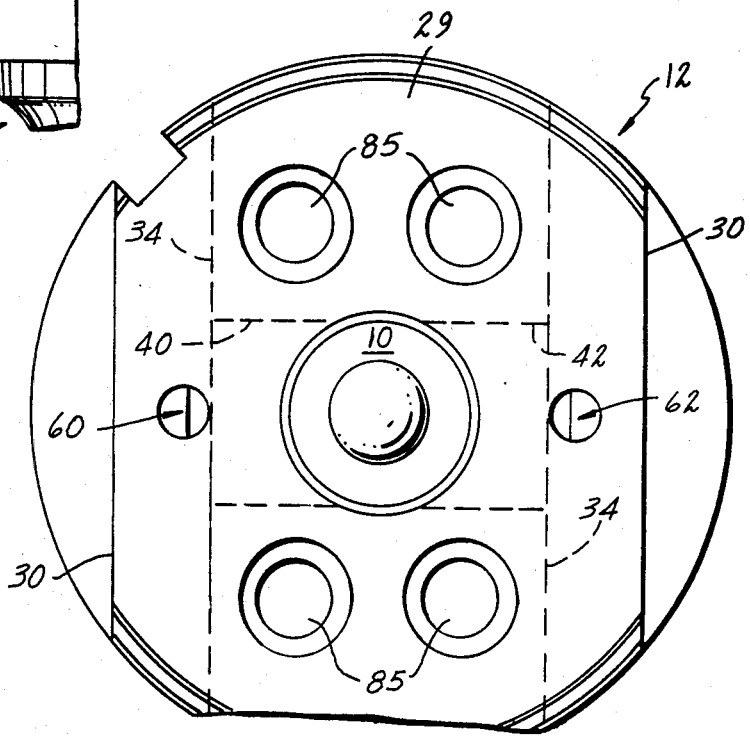
FIG. 4 is a view looking in the direction of the arrow 4 in FIG. 1.
Figure 6:
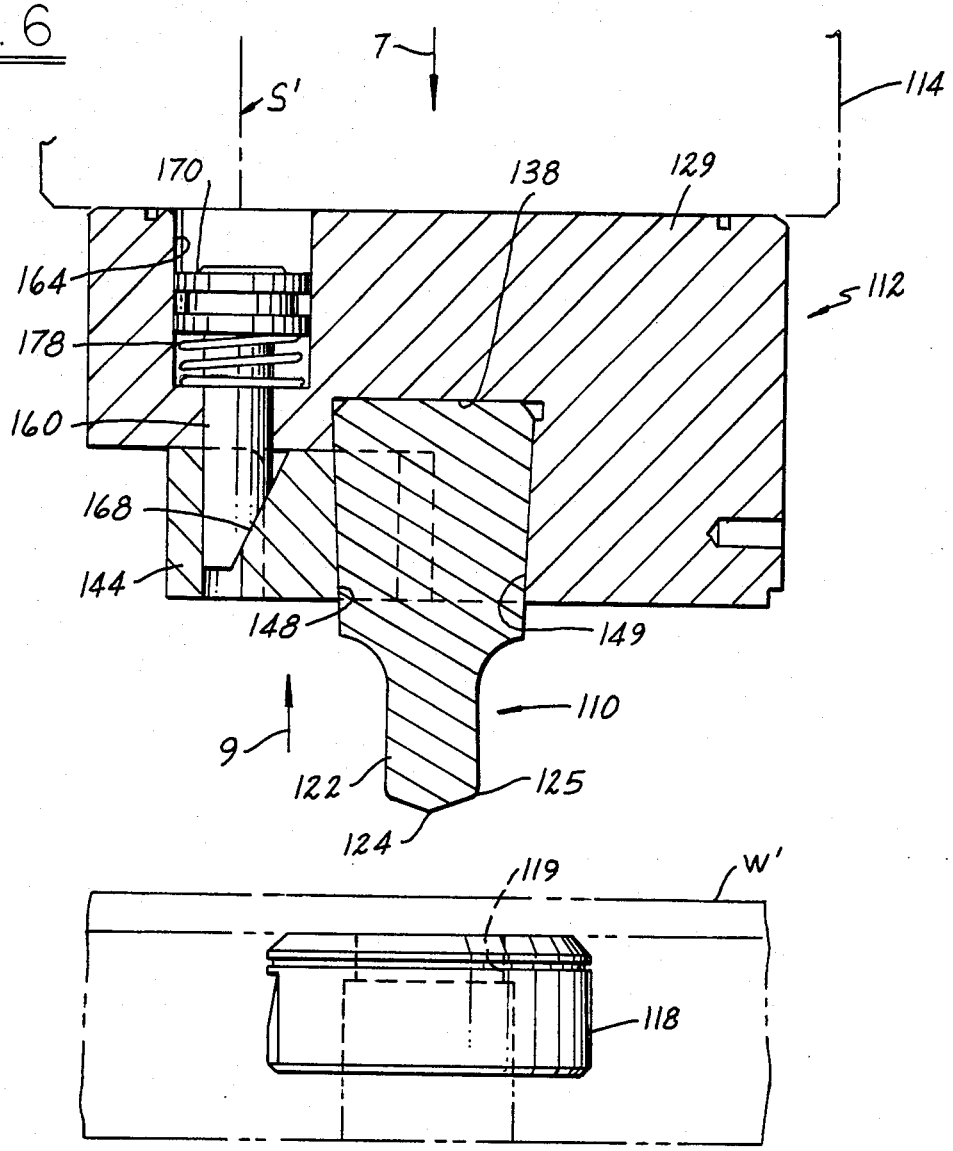
FIG. 6 is a sectional view of a punch and holder of modified construction, taken on the line 6—6 in FIG. 7.

The gripping jaws 44 and 46 are generally T-shaped as seen in FIG. 2, each having a cross head portion 52 on the outer end. Coil springs 54 compressed between the body 29 and the head portions 52 of the gripping jaws urge the gripping jaws outwardly to retracted positions in which the gripping surfaces 48, 50 are withdrawn from contact with the shank of the punch.

Camming members 60 and 62 are provided for camming the gripping jaws 44 and 46 radially inwardly to their advanced positions shown in FIG. 1. The camming members are elongated pins mounted for sliding movement in the parallel passages 64, 66 which extend across the slots 40, 42 at right angles thereto. Such pins extend through openings in the gripping jaws and have tapered side surfaces 68 engagable with correspondingly tapered side surfaces in the openings so that when the pins are moved in an outward direction the gripping jaws are cammed radially inwardly to the advanced FIG. 1 position in which they firmly grip the shank of the punch. The camming members have piston heads 70, 72 reciprocable in hydraulic cylinders 74, 76 formed in the body 29 of the punch holder. The camming members 60, 62 are retracted by means of coil springs 78 compressed between the piston heads and the bottoms of the hydraulic cylinders. The camming members 60, 62 are forced outwardly to their advanced positions shown in FIG. 1 against the action of springs 78 by hydraulic fluid pressure supplied to the head ends of cylinders 74, 76 by the hydraulic pump system S.

The body 29 of the punch holder has holes 85 to receive fasteners which secure it to the ram.

The design of the punch results in excellent wear and anti-galling properties.

In use, the hydraulic fluid pressure is relieved to allow the camming members 60 and 62 to be retracted by the force of springs 78 and the gripping jaws 44, 46 to be retracted by the force of springs 54. The shank of the punch is then inserted into the socket. Hydraulic fluid pressure supplied to the cylinders 74, 76 causes the gripping jaws to be advanced by the camming members into gripping engagement with the shank of the punch. The gripping surfaces 48, 50 being contoured and tapered to match the cylindrical surface of the shank permits full surface-to-surface engagement between the gripping surfaces and the cylindrical surface of the shank. Due to the taper of the shank and the gripping surfaces and the force of the hydraulic pressure on the camming members, the shank is firmly and positively held against accidental withdrawal from the socket.

When the ram is operated to cause the punch to descend rapidly, the piercing end of the punch drives through the work piece W punching a slug of metal through the opening in the die and forming a hole in the work piece. Reversal of the ram causes the punch to withdraw from the work piece and, as stated, the firm and positive grip of the jaws on the punch shank insures that the punch will withdraw cleanly from the work piece and continue to be firmly gripped in the holder.

The punch can be replaced when desired quickly and easily by simply (1) relieving the hydraulic fluid pressure resulting in immediate release of the old punch through the action of springs 54 and 78, (2) removing the old punch and substituting a new one, and (3) reapplying the hydraulic fluid pressure to clamp the new punch in the socket of the holder.

A modification of the invention is shown in FIGS. 6–10. The heavy duty punch 110, which is similar to punch 10 but somewhat different in dimension, is mounted on a holder 112 carried by a ram 114 similar to the one previously described which is reciprocable vertically above table 116 on which a work piece W′ is supported. The action is the same as in the previous embodiment, that is when the ram moves downwardly the punch 110 forms a hole in the work piece and punches a slug of metal through the central opening 119 in the button 118.

Figure 10:
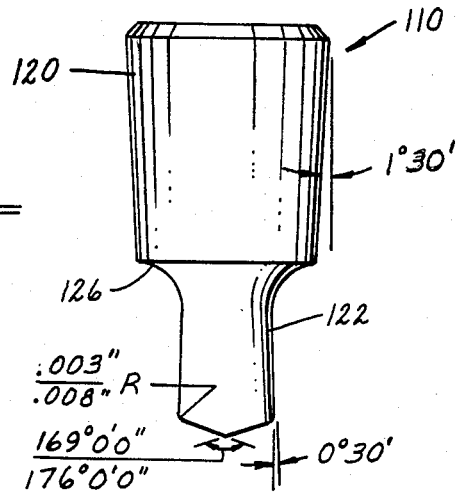
FIG. 10 is a detail view in elevation of the punch in FIGS. 6–9.

The punch 110 is made of the same material as the punch 10 previously described, but has specifically different dimensions because of the somewhat greater hardness of the work piece W′, which again may be armor plate. The punch 110 has a generally cylindrical shank 120 and a piercing end 122 projecting axially from the shank. Actually, although generally cylindrical, the punch shank tapers in an outward direction towards its piercing end. Preferably the angle of taper is 1° 30′ as indicated in FIG. 10 of the drawing.

The piercing end of the punch is generally cylindrical and its central axis coincides with the central axis of the shank. The piercing end flares 0° 30′ in a direction towards the tip.

The piercing end terminates in a conical tip 124 in which the cone angle is 169° to 176°. The generally cylindrical surface of the piercing end connects with the outer margin of the conical tip in a curve 125 having a radius of 0.003″ to 0.008″. The piercing end blends into the shank in a flaring curve of suitable radius where indicated at 126. The piercing end preferably has a boron coated tip as in the case of punch 10.

The same clearance between the piercing end of the punch and the die opening, and the same armor plate thickness may apply to this embodiment of the invention as was specified for the embodiment of FIGS. 1 to 5.

The punch holder 112 comprises a generally cylindrical body 129 having a flat 130 machined or otherwise formed in one side at the outer end thereof.

The punch holder 112 has a frusto-conical socket 138 in the outer end, the central axis of which coincides with the central axis of the cylindrical body 129. The side wall of the socket 138 is tapered and contoured so as to match the generally cylindrical but slightly tapered side wall of the shank of the punch.

A radial slot 140 is machined or otherwise formed in the body 129 of the punch holder and extends from the flat 130 through the side wall of the socket 138.

A gripping jaw 144 is slidably mounted in the slot 140 for radially inward and outward movement relative to the socket. The radially inner or gripping surface 148 of the jaw is tapered and contoured similarly to the wall of the socket so as to match the generally cylindrical but slightly tapered side wall of the shank so that in the inner or advanced position of the jaw the gripping surface 148 will engage one side of the shank in full surface contact therewith. The opposite side wall of the punch shank will be in full surface contact with the socket wall, and hence the socket wall 149 serves as a fixed jaw. The gripping surface 148 of the jaw and the opposed socket wall may be formed of electroplated carbon steel for improved gripping.

The slot 140 has a dove-tail configuration and the main body portion of the gripping jaw 144 has a similar configuration to retain the jaw and prevent it from dropping out of the assembly.

The gripping jaw 144 is generally T-shaped, having a cross head portion 152 on the radially outer end. Coil springs 154 compressed between the body 129 and the head portions 152 urge the gripping jaw outwardly to a retracted position to release the shank of the punch.

A camming member 160 is provided for camming the jaw 144 radially inwardly to its advanced position. The camming member is an elongated pin mounted for sliding movement in the passage 164 which extends across slot 140 at right angles thereto. The pin extends through an opening in the gripping jaw and has a tapered side surface 168 engageable with a correspondingly tapered surface in the opening so that when the pin is moved in an outward direction the gripping jaw is cammed radially inwardly to the advanced FIG. 6 position in which to firmly grip the shank of the punch. The camming member 160 has a piston head 170 reciprocable in hydraulic cylinder 174 formed in the body 129 of the punch holder. The camming member is retracted by means of the coil spring 178 compressed between the piston head and the bottom of the hydraulic cylinder. The camming member 160 is forced outwardly to its advanced position against the action of spring 178 by hydraulic fluid pressure supplied to the head end of the cylinder 174 by the hydraulic pump system S'.

The body 129 of the punch holder has holes 185 to receive fasteners which secure it to the ram.

Hydraulic pressure supplied to cylinder 174 causes the jaw 144 to advance, clamping the shank of the punch between the gripping surface 148 of the movable jaw 144 and the opposed side wall 149 of the socket which serves as a fixed jaw. The tapered surfaces of the jaws and the full surface contact they have with the punch shank insures a firm and positive grip. When the hydraulic pressure is relieved, the jaw 144 is retracted and the punch is released.

The operation of the embodiment of FIGS. 6–10 is the same as for the embodiment previously described.

Considering the prefered dimensions of punches 10 and 110 stated above, such dimensions fall in the following ranges, namely: shank taper of 0° 15' to 1° 30'; flare of piercing end in a direction toward the tip of 0° to 2°; conical tip cone angle of 138° to 176° and radius of curve connecting the generally cylindrical surface of the piercing end and the outer margin of the conical tip of 0.003" to 0.008". All dimensions within these ranges are operable and included within the scope of this invention.

I claim:

1. A heavy duty punch for piercing armor having a shank by means of which it may be held when in use, and a piercing end projecting axially from said shank, said piercing end terminating in a conical tip having a cone angle of 169° to 176°, said piercing end flaring in a direction toward said conical tip at an angle of 0° to 2°, and said piercing end merging into said conical tip in a curve having a radius of 0.003" to 0.008".

2. A heavy duty punch as defined in claim 1, wherein said cone angle is 176°, the angle of flare of said piercing end is 0° 30', and the radius of said curve is 0.005".

* * * * *